US005664257A

United States Patent [19]

Hall

[11] Patent Number: 5,664,257

[45] Date of Patent: Sep. 9, 1997

[54] CONVERTIBLE BAG/HAT/HALTER TOP

[76] Inventor: Richard Hall, 8605 Lanier Dr., Silver Spring, Md. 20910

[21] Appl. No.: 715,171

[22] Filed: Sep. 17, 1996

[51] Int. Cl.[6] ..... A41D 15/00; A41D 15/04

[52] U.S. Cl. ..... 2/69; 2/69.5; 2/73; 2/94; 2/209.11; 2/106; 224/577; 450/1

[58] Field of Search ..... 2/69, 69.5, 50, 2/51, 52, 75, 80, 83, 86, 72, 73, 95, 94, 89, 88, 209.11, 171; 450/1, 91; 224/577

[56] References Cited

U.S. PATENT DOCUMENTS

| | | | |
|---|---|---|---|
| 3,797,043 | 3/1974 | Brument | 2/69.5 |
| 4,067,066 | 1/1978 | Bruno | 2/69.5 |
| 4,158,892 | 6/1979 | Gonzales | 2/69.5 |
| 4,227,264 | 10/1980 | Spector et al. | 2/97 |
| 4,347,629 | 9/1982 | Itoi | 2/69.5 |
| 4,404,687 | 9/1983 | Hager | 2/94 |
| 4,574,397 | 3/1986 | Dennard | 2/69.5 |
| 4,610,038 | 9/1986 | Dennard | 2/209.11 |
| 4,641,380 | 2/1987 | Epstein | 2/209.11 |
| 4,703,521 | 11/1987 | Asher et al. | 2/69.5 |
| 4,773,101 | 9/1988 | Kapp et al. | 2/69.5 |
| 5,075,900 | 12/1991 | Chittenden | 2/97 |
| 5,131,096 | 7/1992 | Olson | 2/69.5 |

FOREIGN PATENT DOCUMENTS

| | | | |
|---|---|---|---|
| 0412335 | 7/1990 | France | 2/209.11 |

*Primary Examiner*—Jeanette E. Chapman
*Attorney, Agent, or Firm*—Michael Aronoff

[57] ABSTRACT

A combination, convertible hat/bag/halter top formed from an elasticized strip which can be connected at a first end to form a closed loop, to which a dividable body is attached. The elasticized strip may be connected at one end to form a closed loop. The article converts easily into a hat, a bag and a halter top.

3 Claims, 4 Drawing Sheets

CONVERTIBLE BAG/HAT/HALTER TOP

BACKGROUND OF THE INVENTION

1. Field of the Invention

The present invention relates to an improvement in the construction of a convertible article which serves multiple functions. More specifically, the present invention provides for the construction of an article which functions as a hat, a bag and a halter top.

2. Brief Description of the Prior Art

In the past, convertible articles of this type have had limited usefulness for functions other than that of a hat or a bag, and have been difficult and complicated to convert between the intended uses. The design of these articles consisted essentially of a tubular type body, closed at one end, which formed the shape of the hat and the cavity of the bag. However, this design has little potential for other uses. These limitations are illustrated in U.S. Pat. No. 5,303,437 to Fishbaine and U.S. Pat. No. 5,214,802 to McCallum, in which the use is limited to a hat and a bag, and the conversion from one use to another is unnecessarily complex. Thus, it would be useful to have an article that is easily convertible to a hat and to a bag and which may also serve the further function of a halter top.

SUMMARY OF THE INVENTION

It is the primary objective of the present invention to provide a new assembly which functions as a hat, a bag and a halter top, which is easily convertible from one function to another depending upon the desired needs of the user.

These objectives are accomplished by providing a strip of elasticized material to which a body portion of the present invention is attached. The strip of material may be, depending upon the function for which the present invention is being utilized, connected at its ends to form a closed loop. A thin, durable rope or other similar material is sewn into the strip of elasticized material to form a drawstring by which the circumference of the elasticized strip may be reduced, and also serving as a handle. The body portion of the present invention is longitudinally divided by a zipper mechanism, which may be open or closed depending on the configuration desired.

In one embodiment of the present invention, the elasticized strip is closed by means of eye hooks, Velcro or snaps, and the zipper mechanism is in the closed position. This forms a cavity in which various personal articles may be carried. In this configuration, the drawstring serves as a means by which the opening in the top of the bag may be closed, and also serves to form a handle by which the bag may be carried by the user.

In another embodiment of the present invention, the elasticized strip is fastened by one of the above described methods and the zipper is in the closed position. This configuration forms a beret-like hat in which the drawstring may be used to size the opening to fit around the user's head. The drawstring may then be tucked inside the body of the present invention, thus forming a hat.

Still another embodiment of the present invention, the elasticized strip is not closed and the zipper is in the open position. In this configuration, the drawstring is used to fasten the present invention around the user's rib cage, forming a halter top. Also, there is an additional strap which can be attached to the inside of each half of the open body portion of the present invention by means of an eye hook, Velcro or snaps, which encircles the user's neck to hold the body portion of the present invention in place.

For a better understanding of the present invention, reference should be made to the accompany drawings in which there is illustrated and described the preferred embodiments of the present invention.

DESCRIPTION OF THE PREFERRED EMBODIMENT

Figure 1:
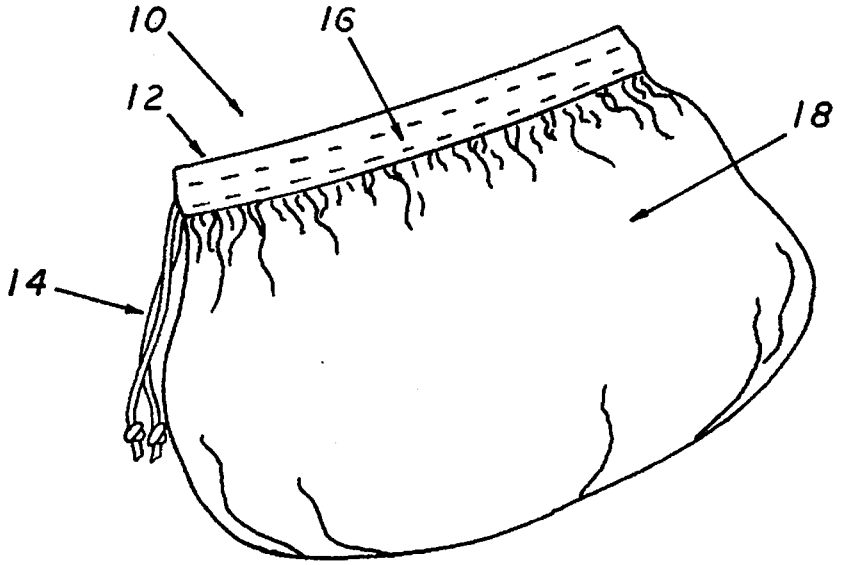
FIG. 1 is a front perspective view of the present invention showing the orientation of its major components in a first configuration.
Figure 2:
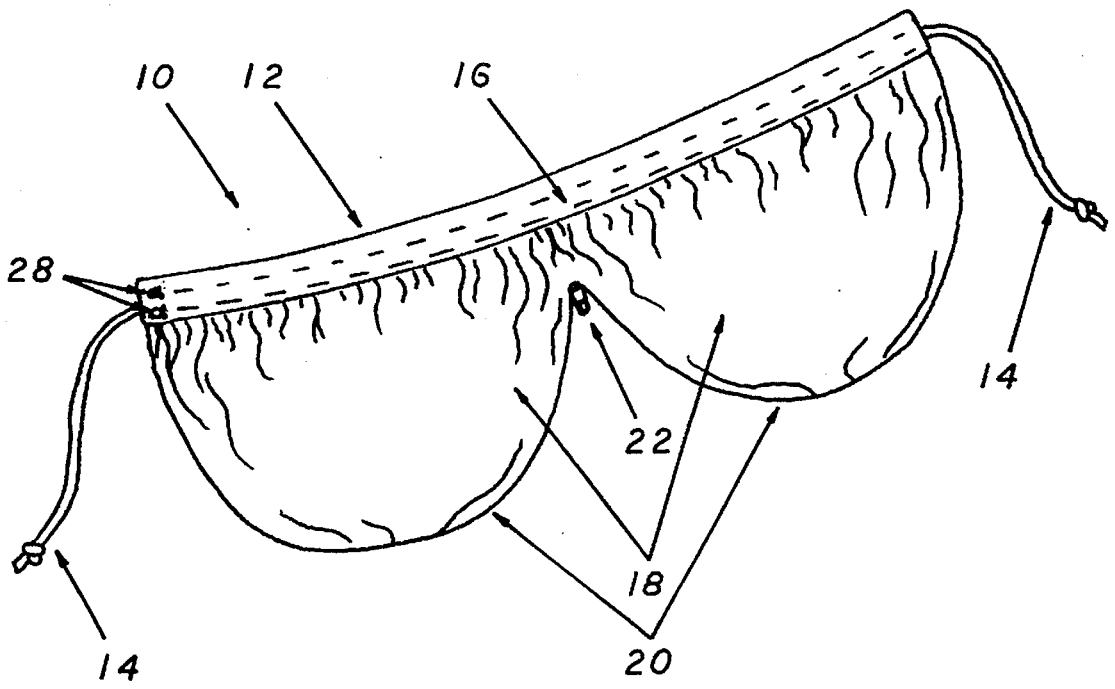
FIG. 2 is a front perspective view of the present invention showing the orientation of its major external components when in a second configuration.
Figure 3:
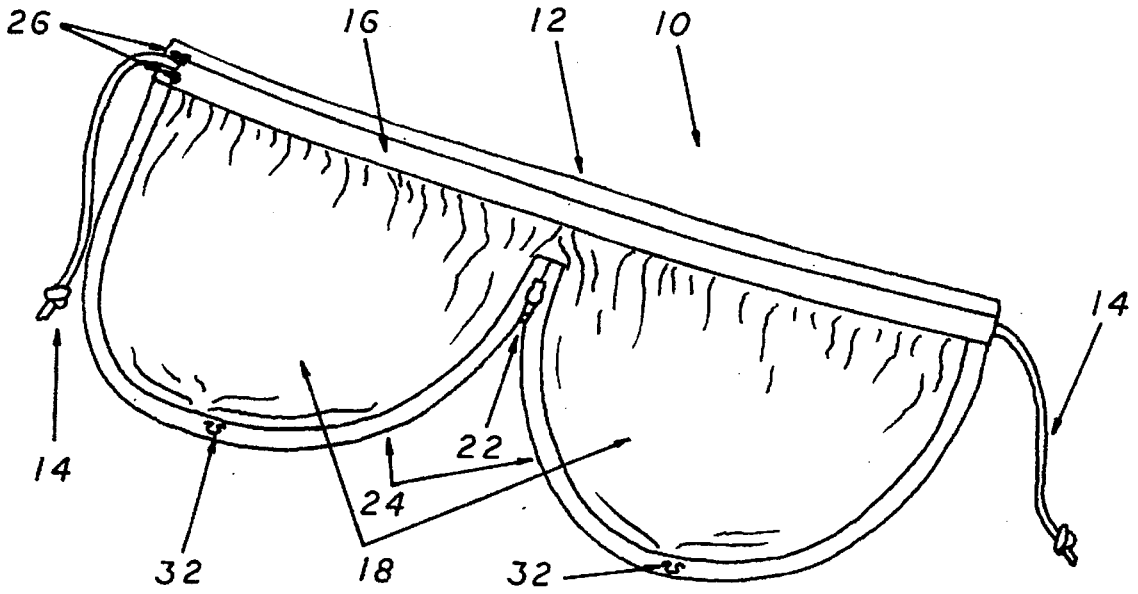
FIG. 3 is a rear perspective view of the present invention showing the orientation of its major internal components when in the second configuration.
Figure 4:
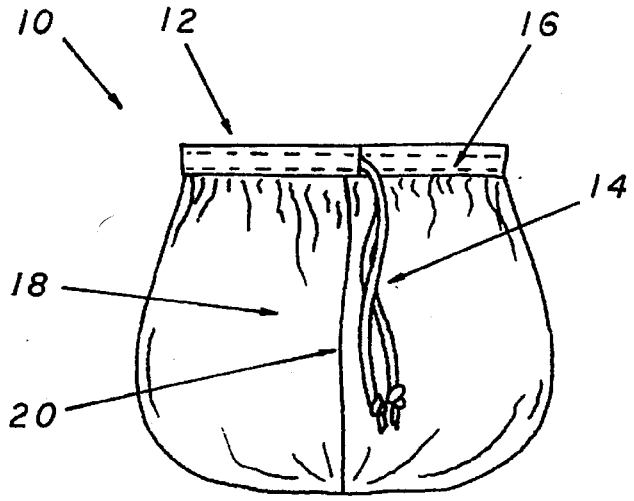
FIG. 4 is a side elevation view of the present invention in the first configuration showing the position of a zipper seam.

Referring now to the drawings, and more specifically to FIGS. 1, 2, 3, and 4, the convertible hat/bag/halter top 10, hereinafter referred to as the main structure, will be described. The main structure 10 comprises an elasticized strip 12. Within the elasticized strip 12 is a drawstring hem 16, which encloses a drawstring/handle 14. The drawstring/handle 14 passes through the entire length of the elasticized strip 12, and a portion of the drawstring/handle 14 extends beyond the end of the elasticized strip 12 on either end. Additionally, attached to the inner side of one end of the elasticized strip 12 are closure hooks 26, and on the opposite end of the elasticized strip are attached closure eyes 28, which, when affixed to one another, close the elasticized strip 12, forming a circular opening.

The body portion 18 is attached to the lower edge of the elasticized strip 12, thus forming a bag-like enclosure when the elasticized strip 12 is closed by the closure of the eyes and hooks 26 and 28. The body portion 18 is hemisperically divided by a zipper seam 20, which holds zipper 24 and zipper tongue 22. Also attached to the inside of the zipper seam 20 are shoulder strap eyes 32.

Figure 5:
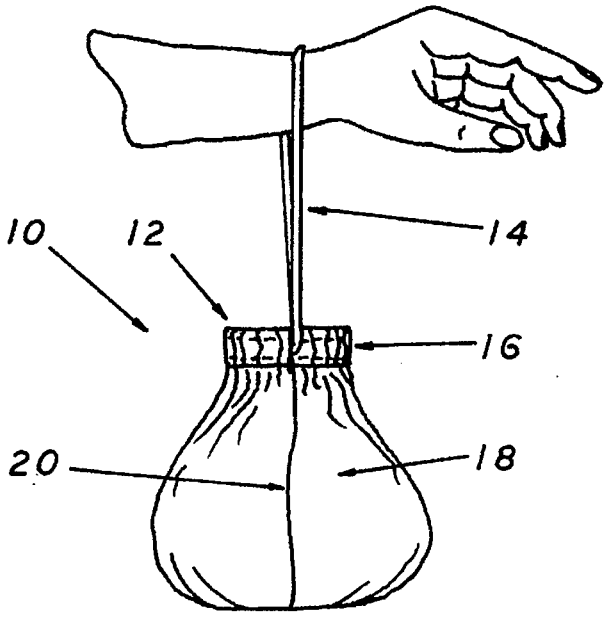
FIG. 5 is a perspective view of the present invention in the first configuration showing the manner in which it may be used as a hand bag.

FIG. 5 shows the embodiment of the Convertible Hat/Bag/Halter Top 10 in the first configuration as a handbag. In this configuration, elasticized strip 12 is cinched closed by use of the drawstring/handle 14 located within the drawstring hem 16 and the elasticized strip 12. Additionally, the body portion 18 and the zipper seam 20 are in their closed position, thus forming a cavity in which personal items may be stored. The outwardly extending ends of the drawstring/handle 14 may be tied together, thereby forming a loop, which may be used as a carrying handle by the user.

Figure 6:
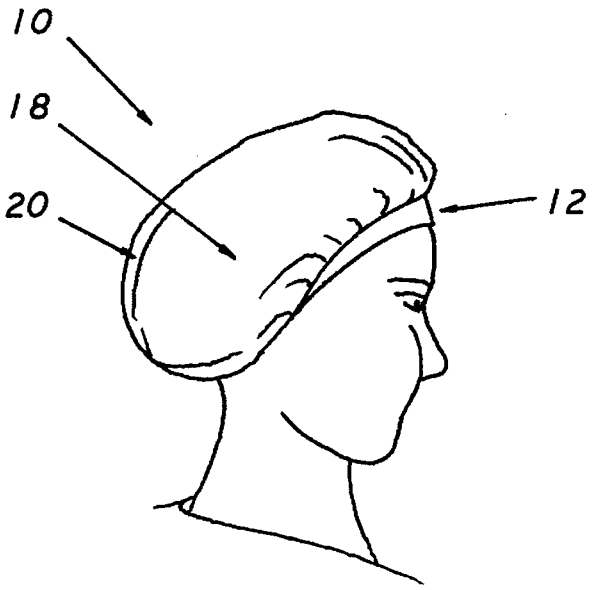
FIG. 6 is a perspective view of the present invention in a third configuration showing the manner in which it may be used as a hat.

FIG. 6 shows the embodiment of the Convertible Hat/Bag/Halter Top 10 in the second configuration as a hat. In this configuration, the elasticized strip 12 and the zipper seam 20 are in their closed positions as described above, and the elasticized strip 12 is fitted to the user's head. The body 18 thus forms the enclosing portion of the hat, thereby covering the user's head.

Figure 7:
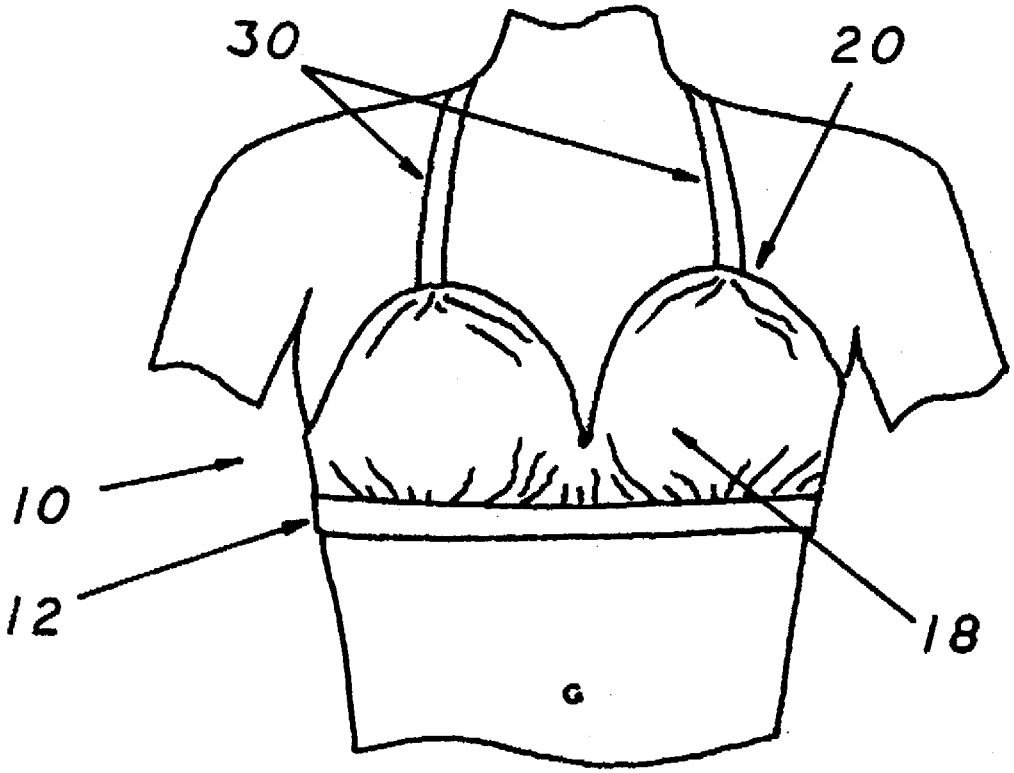
FIG. 7 is a front elevation view of the present invention in the second configuration showing the manner in which it may be used as a halter top.

FIG. 7 shows an embodiment of the Convertible Hat/Bag/Halter Top 10 in the third configuration as used as a halter top. In this configuration, the elasticized strip 12 and the two hemispheres of the body 18 are in an open position. The should strap 30 is attached at each end at the zipper seam 20, and encircles the user's neck, thereby providing a means to hold the body 18 in place.

Although the present invention has been described in considerable detail with reference to certain preferred versions thereof, other versions are possible. Therefore, the spirit and scope of the appended claims should not be limited to the description of the preferred versions contained herein.

What is claimed is:

1. A convertible hat/bag/halter top article comprising:

a first piece of material having a generally strip shape, the first piece of material having a first terminal end and a second terminal end, a top portion and a bottom portion, wherein the first terminal end and the second terminal end include means for coupling the first terminal end to the second terminal end;

a second piece of material having a generally linear first edge, wherein the first edge is attached to the top portion of the first piece of material, and a second edge wherein the second edge has two adjacent generally semicircular portions;

means for connecting the two semicircular portions of the second edge to each other, wherein the means for connecting two semicircular portions are attached to the semicircular portions;

a third piece of material having a first terminal end and a second terminal end, each terminal end adapted for connection to one of the semicircular portions; and means for attaching the third piece of material to each of the semicircular portions.

2. A convertible hat/bag/halter top article as stated in claim 1, wherein the first piece of material forms a closed loop when the first terminal end is coupled to the second terminal end, the loop having a circumferential length and further comprising means for reducing the loop circumferential length, the reducing means associated with the first piece of material.

3. A convertible hat/bag/halter top article as stated in claim 1, wherein the means for connecting the two semicircular portions of the second edge to each other is a zipper mechanism attached to the semicircular portions and wherein when the two semicircular portions are connected a cavity is formed by the second piece of material, for carrying various items.

* * * * *